United States Patent [19]

Qualeatti et al.

[11] 4,446,073

[45] * May 1, 1984

[54] PROCESS FOR THE REDUCTION OF UNSATURATED CARBOXYLIC ACIDS

[75] Inventors: Gail M. Qualeatti, Palatine; Dalia Germanas, Des Plaines, both of Ill.

[73] Assignee: UOP Inc., Des Plaines, Ill.

[ * ] Notice: The portion of the term of this patent subsequent to Jul. 20, 1999 has been disclaimed.

[21] Appl. No.: 290,120

[22] Filed: Aug. 5, 1981

[51] Int. Cl.[3] ..... C11C 3/12

[52] U.S. Cl. ..... 260/409; 260/410; 260/410.9 R; 260/410.9 N; 560/205; 560/225; 568/885

[58] Field of Search ..... 260/409, 410.9 R, 410.9 N, 260/410.9 D; 560/205, 225; 568/885

[56] References Cited

U.S. PATENT DOCUMENTS

| | | | |
|---|---|---|---|
| 1,997,172 | 4/1935 | Goldschmidt et al. | 260/410.9 R X |
| 2,127,367 | 8/1938 | Normann et al. | 260/410.9 R |
| 3,377,388 | 4/1968 | Pantulu et al. | 260/410.9 R |
| 4,338,221 | 7/1982 | Qualeatti et al. | 560/225 X |
| 4,340,546 | 7/1982 | Qualeatti et al. | 560/225 X |

*Primary Examiner*—Helen M. S. Sneed

*Attorney, Agent, or Firm*—James R. Hoatson, Jr.; Raymond H. Nelson; William H. Page, II

[57] ABSTRACT

Unsaturated carboxylic acids may be reduced to an ester or to a corresponding alcohol by treatment with hydrogen in the presence of a reducing catalyst. The reducing catalyst which is used in the present invention comprises cadmium and ruthenium in a low valence oxidation state composited on a solid support. If so desired, the catalyst may also contain a platinum group metal of Group VIII of the Periodic Tale. By utilizing this catalyst which may be exemplified by cadmium, ruthenium and platinum composited on gamma alumina in a process in which hydrogen is continuously bled from the reaction vessel, it is possible to obtain products in which the carboxyl group of the molecule has been reduced without materially reducing the double bonds of the compound.

11 Claims, No Drawings

PROCESS FOR THE REDUCTION OF UNSATURATED CARBOXYLIC ACIDS

BACKGROUND OF THE INVENTION

It is known that unsaturated carboxylic acids may be reduced to an ester or to the corresponding alcohol. However, the reducing catalysts which have heretofore been employed are not selective in the hydrogenation process, and thus the reductive process usually results in eliminating the retention of the unsaturation in the carbon chain. The compound whch is obtained is therefore a saturated ester or alcohol. This is true when utilizing catalysts such as a mixture of copper and chromium oxide or rhenium catalysts which may be used in either a supported or unsupported state or which may also contain a noble metal of Group VIII of the Periodic Table, such as platinum, palladium or ruthenium.

In many instances, it is desirable to retain the unsaturation of the carbon chain when obtaining either alcohols or esters of the starting unsaturated carboxylic acid. As will hereinafter be shown in greater detail, it has now been discovered that a process for effecting the reduction of unsaturated carboxylic acids may be effected by utilizing certain catalytic compositions of matter and also by utilizing certain modifications of the process to obtain esters or alcohols of unsaturated carboxylic acids in which the double bonds present in the original acid are retained in the reaction product.

DETAILED DESCRIPTION OF THE INVENTION

This invention relates to a process for the reduction of unsaturated carboxylic acids. More specifically, the invention is concerned with a process for treating unsaturated carboxylic acids of the type hereinafter set forth in greater detail to effect a reduction of said acids in which the unsaturated bonds which are present in the original acid are retained in the product.

Unsaturated acid esters, or alcohols, especially those which possess a relatively long carbon atom chain, will find a wide variety of uses in the chemical field. The unsaturated acid esters, as exemplified by oleyl oleate, may be used as a substitute for sperm whale oil which is becoming increasingly difficult to obtain. Sperm whale oil is used as a high grade lubricating oil for light machinery such as watches, clocks and scientific instruments as well as in heat-treating and rustproofing. In addition to use as a lubricant, the esters which are obtained according to the process of this invention may also be used in cosmetics such as perfumes, colognes, bath oils, soaps, powders, etc. This is especially true in the case of relatively long chain unsaturated esters.

It is therefore an object of this invention to provide a process for the reduction of unsaturated carboxylic acids.

A further object of this invention is to provide a process for the reduction of an unsaturated carboxylic acid whereby the ester and/or alcohol product resulting from the process will retain the unsaturation of the starting material.

In one aspect an embodiment of this invention resides in a process for the reduction of an unsaturated carboxylic acid which comprises treating said acid in a reaction system in the presence of hydrogen and a reduction catalyst comprising cadmium and ruthenium in a low valence oxidation state composited on a solid support at treatment conditions, continuously bleeding said hydrogen from said system during the reaction period, and recovering the resultant unsaturated product.

A specific embodiment of this invention is found in a process for the reduction of an unsaturated carboxylic acid which comprises treating oleic acid in a reaction system in the presence of hydrogen and a reduction catalyst comprising cadmium, ruthenium, and platinum composited on gamma-alumina, said process being effected at a temperature in the range of from about 100° to about 500° C. and a pressure in the range of from about 100 to about 5000 lbs/sq. in., continuously bleeding hydrogen from said reaction system during the reaction period, and recovering the resultant oleyl oleate, oleyl alcohol and/or their geometric and positional isomers.

Other objects and embodiments can be found in the following further detailed description of the present invention.

As hereinbefore set forth, the present invention is concerned with a process for the reduction of an unsaturated carboxylic acid in which said acid is treated with hydrogen in the presence of a reduction catalyst of the type hereinafter set forth in greater detail. By employing this catalyst, and also by employing certain reaction conditions, it is possible to obtain the resulting ester and/or alcohol in an amount in excess of that which has previously been obtained, as well as retaining the unsaturation in the carbon atom chain which is present in the starting material. As will hereinafter be shown in greater detail, by effecting a hydrogen bleed during the reaction, the product water which is formed during the reaction is continuously removed, thus permitting an enhanced activity and selectivity of the reaction to form the desired products.

Examples of unsaturated carboxylic acids which may be employed as starting materials to form the desired unsaturated esters will include those acids containing from 3 to about 22 carbon atoms, some specific examples of these acids being acrylic acids; the isomeric butenic acids such as crotonic acid, isocrotonic acid, vinyl acetic acid, methylacrylic acid; the isomeric pentenic acids such as tiglic acid, angelic acid, senecioic acid; the isomeric hexenoic acids; heptenoic acids; octenoic acids; nonenoic acids; decenoic acids; undecenoic acids; dodecenoic acids; tridecenoic acids; tetradecenoic acids; pentadecenoic acids; hexadecenoic acids such as hypogeic acid; heptadecenoic acids; octadecenoic acids such as oleic acid, elaidic acid; nonadecenoic acid; eicosenoic acids; erucic acid; brassidic acid, etc. It is to be understood that the aforementioned unsaturated carboxylic acids are only representative of the type of compounds which may be employed to form the desired esters, and the the present invention is not necessarily limited thereto.

The catalyst which is employed to effect the reduction of the aforesaid acids without affecting the unsaturation thereof will be a catalytic composite comprising cadmium and ruthenium composited on a solid support. In addition, if so desired, the catalytic composite may also contain a platinum group metal of Group VIII of the Periodic Table also composited thereon, said platinum group metal including platinum, palladium, rhodium, etc. The cadmium will be present on the solid support in a low valence oxidation state usually in the form of cadmium oxide or metallic cadmium, in an amount in the range of from about 1 to about 10% by weight of the composite. Likewise, the ruthenium which comprises the second component of the catalytic composite will be present in a low valence oxidation state in an amount in the range of from about 0.1 to about 2% by weight of the composite, while the noble metal, if one is utilized as a third component of the catalytic composite, will also be present in a low valence oxidation state in an amount in the range of from about 0.01 to about 2.5% by weight of the finished composite.

The aforementioned cadmium and ruthenium, along with, if so desired, a platinum group metal of Group VIII of the Periodic Table, will be composited on the solid support which, in the preferred embodiment of the invention, comprises a relatively high surface area inorganic oxide. Examples of these inorganic oxides will include aluminas such as gamma-alumina, eta-alumina, theta-alumina, silica or mixtures of inorganic oxides such as alumina-silica, silica-zirconia, silica-magnesia, alumina-silica-zirconia, etc.

The reduction catalysts which are used in the process of the present invention may be prepared in any suitable manner. An example of the type of preparation which may be used comprises impregnating the solid support, such as gamma-alumina, with an aqueous HCl solution of a ruthenium-containing compound such as ruthenium trichloride trihydrate ($RuCl_3.3H_2O$) for a period of time which is sufficient to allow the deposition of the desired amount of ruthenium on the solid support, that is, an amount sufficient so that the finished catalyst composite will contain from about 0.1 to about 2% of ruthenium. After recovery of the impregnated solid support, the composite is then calcined at a temperature in the range of from about 250° to about 750° C. in an air atmosphere for a period of time which may range from about 0.5 up to about 4 hours in duration. The calcined composite is then subjected to a reducing treatment by heating the composite at a temperature within the range hereinbefore set forth in a hydrogen atmosphere for a period of time sufficient to reduce the ruthenium to a low valence oxidation state. In the event that it is desired to have a noble metal of Group VIII of the Periodic Table also present in the catalyst composite, this metal is co-impregnated with the ruthenium utilizing an aqueous solution of a noble metal-containing compound such as chloroplatinic acid, chloropalladic acid, rhodium chloride, etc. Following the co-impregnation, the composite is then treated in a manner similar to that hereinbefore set forth, that is, it is calcined and reduced. As in the case of the ruthenium, the co-impregnation with the noble metal is also effected by utilizing a sufficient amount of aqueous solution so that the noble metal will be present in the final catalyst composite in an amount in the range of from about 0.01 to about 2.5% by weight of the finished composite.

The thus formed composite containing ruthenium and, if so desired, a noble metal, is thereafter impregnated with a solution of cadmium salt, said cadmium being present in an amount so that the finished catalyst will contain from about 1 to about 10% by weight of cadmium. Examples of cadmium salts which may be employed to effect the impregnation will preferably consist of organic salts of cadmium such as cadmium formate, cadmium acetate, cadmium propionate, etc., although it is also contemplated within the scope of this invention that some inorganic salts of cadmium, such as cadmium chloride, cadmium bromide, cadmium phosphate, etc. may also be employed, although not necessarily with equivalent results. In the preferred embodiment of the invention, the impregnation of the catalyst composite with cadmium is effected under a nitrogen blanket in order to provide an inert atmosphere for the aforesaid impregnation step. After allowing the impregnation with the cadmium salt to be effected for a predetermined period of time, which may range from about 0.5 up to about 4 hours or more in duration, the resultant composite is then recovered and calcined under nitrogen at a temperature in the range of from about 250° to about 400° C. to form cadmium oxide. Following this, if so desired, the composite is then reduced in a hydrogen atmosphere using similar temperatures to convert the cadmium to a low valence oxidation state. Upon completion of the calcination and reduction periods, the resulting composite which forms the catalyst may be utilized in the reduction process of the present invention.

It is also contemplated within the scope of this invention that the catalyst which is used in the process of the present invention may be prepared in a continuous manner of operation. When such a type of operation is employed, the solid support material comprising an inorganic oxide which may be of any desired shape such as pellets, spheres, globules, rods, etc. is continuously passed through an aqueous solution of ruthenium at a predetermined rate of speed in order that the predetermined amount of ruthenium may be impregnated on the support. The support after passage through the solution is continuously withdrawn and passed to a calcination zone wherein it is treated at an elevated temperature, in the presence of air, within the range hereinbefore set forth. After completion of the calcination period, the ruthenium impregnated material is then, if so desired, passed through a second impregnating bath wherein the noble metal of the Group VIII Periodic Table is deposited thereon. Alternatively, it is also contemplated that the noble metal and the ruthenium may be co-impregnated in a single impregnation zone following which the impregnated solid support is calcined and thereafter subjected to a reducing step in which the impregnated support is continuously passed through a reducing zone at an elevated temperature while being subjected to a hydrogen flow. After passage through the reducing zone, the metal impregnated solid support is continuously withdrawn and passed to a different impregnation zone wherein the composite is impregnated with cadmium utilizing a cadmium salt of the type previously discussed. The impregnation of the composite with cadmium is effected in the presence of nitrogen for a period of time sufficient to deposit the desired amount of cadmium on the composite. The cadmium-treated composite is then continuously withdrawn and passed to a second calcination zone where it is also calcined at an elevated temperature in the presence of nitrogen to form cadmium oxide. After passage through this latter calcination zone, the desired composite is passed to a reduction zone wherein the cadmium oxide is reduced to a low valence oxidation state by treatment in a hydrogen atmosphere, following which the composite is continuously withdrawn and recovered.

The reduction process of the present invention which results in the obtention of esters and alcohols which still possess the unsaturation of the starting materials and which are recovered in an amount greater than that which was hereinbefore obtained may be effected in either a batch or continuous type operation. When utilizing a batch type operation, a quantity of the unsaturated carboxylic acid, which is used to undergo esterification or to obtain an alcohol, is placed in an appropriate apparatus which is pressure resistant in nature, such as an autoclave of the rotating, mixing or stirring type. In addition, the particular catalyst hereinbefore described is also added to the apparatus in an amount in the range of from about 25:1 to about 5:1 grams of acid per gram of catalyst. After pressuring the apparatus to an initial operating pressure, the apparatus is then heated to the desired operating temperature and maintained thereat for a predetermined period of time. The operating conditions which are employed to effect the desired reduction process will include a temperature in the range of from about 100° to about 500° C. and a superatmospheric pressures ranging from about 100 to about 5000 psi for a period of time which may range from about 0.5 up to about 10 hours or more in duration, the reaction time being determined by the particular unsaturated carboxylic acid undergoing reduction as well as the reaction temperature and amount of pressure which is employed during the reaction. The superatmospheric pressures which are employed may be afforded by hydrogen alone or, if so desired, the amount of hydrogen present may afford only a partial pressure, the remainder of the desired operating pressure being afforded by the presence of an inert gas such as nitrogen, helium, argon, etc. in the reaction apparatus. During the reaction period, a predetermined amount of hydrogen is continuously bled from the reaction vessel, the water which is formed as a side product during the reaction being removed along with the hydrogen. The amount of hydrogen which is bled from the reaction apparatus will be dependent upon the amount charged, said amount which is recovered being sufficient enough to maintain the desired operating pressure at a predetermined level. Upon completion of the desired reaction period, the hydrogen charge is discontinued as is the heat treatment, and after the reaction vessel or apparatus has returned to room temperature, the excess pressure is discharged, the apparatus is opened, and the reaction mixture is recovered therefrom. The thus recovered mixture may then be filtered to separate the catalyst from the reaction product, the latter then being subjected to conventional means of separation to recover the desired ester and/or alcohol.

It is also contemplated within the scope of this invention that the reduction process may be effected in a continuous manner of operation. When such a type of operation is employed, a reaction vessel containing the reduction catalyst is maintained at the proper operating conditions of temperature and pressure, the unsaturated carboxylic acid which is to undergo reduction is continuously charged to the reaction vessel where it is contacted with the catalyst in the presence of hydrogen which is also continuously charged to the reactor. After passage through the reaction vessel for a predetermined period of time, the reactor effluent is continuously withdrawn from the reaction vessel and subjected to conventional means of separation whereby the desired ester or alcohol of the unsaturated carboxylic acid, which still possesses the unsaturation of the starting material, is separated and recovered, while any unreacted starting materials, both gaseous and liquid in nature, after being dried to remove the water formed during the reaction, are recycled to the reaction vessel to form a portion of the feedstock.

It is contemplated that the continuous method of operation may be effected in various ways. For example, the reduction catalyst may be positioned in the reaction vessel as a fixed bed, and the unsaturated carboxylic acid undergoing reduction is passed over the bed in either an upward or downward flow. Another method of effecting the reaction is to employ the catalyst as a moving bed in the reaction vessel and having the unsaturated carboxylic acid and the catalyst pass through the reaction vessel either concurrently or countercurrently to each other. Likewise, if so desired, a slurry-type of operation may be employed in which the reduction catalyst is carried into the reaction vessel as a slurry in the unsaturated carboxylic acid.

The following examples are given to illustrate the process of this invention. However, it is to be understood that the examples are given merely for purposes of illustration and that the present invention is not necessarily limited thereto.

EXAMPLE I

To illustrate the process of the present invention, a catalyst was prepared by impregnating 75 grams of alumina with 150 ml of a 6% aqueous hydrogen chloride solution containing 0.97 gram of ruthenium trichloride trihydrate and 0.1 gram of chloroplatinic acid to afford a 0.5% ruthenium to base ratio and a 0.1% platinum to base ratio. The alumina plus impregnating solution was steam dried for a period of 4 hours followed by calcination at a temperature of 500° C. for a period of 2 hours. Thereafter, the calcined composite was reduced in a hydrogen atmosphere at a temperature of 500° C. for a period of 1 hour. The reduced composite was then impregnated with a cadmium acetate solution under a nitrogen atmosphere by evaporation at steam temperatures to afford a 7% cadmium oxide to base ratio. This composite was then calcined in a nitrogen atmosphere at 275° C. for a period of 2 hours and thereafter reduced in a hydrogen atmosphere for 1 hour at a temperature of 275° C. to afford a catalyst comprising low valence oxidation state cadmium, ruthenium, and platinum composited on alumina.

A feedstock comprising 200 grams of oleic acid and 10 grams of the catalyst prepared according to the above paragraph was charged to a 1-liter stirred autoclave which was then sealed and flushed twice with hydrogen. The autoclave was then pressured to 100 psig with hydrogen and heated to a temperature of 325° C. Upon reaching the desired operating temperature, the autoclave was further pressurized to 750 psig with hydrogen, and the reaction was allowed to proceed for a period of 3 hours while maintaining the temperature at about 325° C. and a pressure of 750 psig. During the 3 hour reaction period, hydrogen was bled from the autoclave at a rate of one $ft.^3$/hr., while stirring the autoclave at a rate of 1100 rpm. In addition, a sufficient amount of hydrogen was charged to the autoclave to maintain the aforesaid pressure. At the end of the 3 hour period, heating was discontinued and after the autoclave had returned to room temperature the excess pressure was vented and the autoclave was opened. The reaction mixture which was recovered from the autoclave was filtered to remove the catalyst. Analysis of the product disclosed that there had been an 88% conversion of the oleic acid to esters and alcohols including oleyl oleate, oleyl alcohol as well as geometric and positional isomers thereof with only 13% saturation of the double bond. The selectivity as measured by the percent of acid conversion divided by the percent of double bond saturation was 6.8.

EXAMPLE II

As an illustration of the advantage of utilizing a catalyst containing the metals in a reduced form, a second catalyst was prepared in a manner similar to that set forth in Example I above, that is, by co-impregnating alumina spheres with ruthenium trichloride trihydrate and chloroplatinic acid in an aqueous hydrogen chloride solution. At the end of the 4 hour period of evaporation at steam temperature, the impregnated alumina was calcined at a temperature of 500° C. for a period of 2 hours followed by reduction in a hydrogen atmosphere for an additional period of 1 hour at the same temperature. The composite was then impregnated with a cadmium acetate solution under a nitrogen atmosphere by evaporation at steam temperatures, followed by calcination under a nitrogen atmosphere at a temperature of 275° C. for a period of 2 hours.

As in Example I above, 200 grams of oleic acid and 10 grams of the catalyst composite prepared according to the above paragraph were charged to a 1-liter stirred autoclave. The autoclave was flushed with hydrogen, sealed and pressured to 100 psig with hydrogen. The autoclave was then heated to a temperature of about 325° C., further pressured with hydrogen, and stirred at a rate of 1100 rpm. The reaction was allowed to proceed for a period of 3 hours at a temperature of 325° C. while bleeding hydrogen from the autoclave at a rate of 1 cu. ft. per hour, meanwhile charging a sufficient amount of hydrogen to the autoclave to maintain a pressure of 750 psig. At the end of the 3 hour period, heating was discontinued and after the autoclave had returned to room temperature the excess pressure was vented and the autoclave was opened. The reaction product was recovered and filtered in a manner similar to that hereinbefore set forth. Analysis of the product disclosed that there had been only a 34% conversion of the oleic acid to predominately esters and alcohols including oleyl oleate, oleyl alcohol, as well as geometric and positional isomers thereof with an 11% saturation of the double bond, the selectivity being 3.1.

EXAMPLE III

To further illustrate the particular properties of the catalyst of the present invention, another catalyst was prepared which comprised cadmium and ruthenium alone composited on alumina. The catalyst was prepared by impregnating alumina with an aqueous hydrogen chloride solution containing ruthenium trichloride trihydrate, followed by calcination in air and reduction in hydrogen at temperatures of 500° C. The reduced composite was then impregnated with a cadmium acetate solution under a nitrogen atmosphere. Following this, the composite was calcined in a nitrogen atmosphere at 275° C. and reduced in a hydrogen atmosphere at similar temperature to afford a catalyst comprising cadmium and ruthenium in a low valence oxidation state composited on alumina.

The thus prepared catalyst was utilized in a reduction reaction involving the treatment of oleic acid under reaction conditions similar to those hereinbefore set forth. Analysis of the product which was recovered at the end of the reduction indicated that there had been only a 42% conversion of the oleic acid to esters and alcohols with an 8% reduction of the double bond. While the selectivity of the experiment was 5.21, the low conversion of the feedstock would render the use of such a catalyst impractical and economically unattractive.

EXAMPLE IV

To illustrate the unexpected degree of selectivity which is obtained when using a continuous hydrogen bleed during the reaction period, a catalyst similar to that described in Example III above was utilized to treat oleic acid. The feedstock comprising 200 grams of oleic acid and 10 grams of a catalyst comprising cadmium and ruthenium in a low valence oxidation state composited on alumina was charged to a 1-liter stirred autoclave which was then sealed and flushed twice with hydrogen. The autoclave was then pressured to 100 psig with hydrogen and heated to a temperature of 300° C. Upon reaching the desired operating temperature, the autoclave was further pressured to 1000 psig. The reaction was allowed to proceed for a period of 4 hours while maintaining the desired operating conditions which include a temperature of about 300° C. and a pressure of 1000 psig, the autoclave being stirred at a rate of 1100 rpm. At the end of the 4 hour period, during which time no hydrogen was bled from the reactor, heating was discontinued and after the autoclave had returned to room temperature, the excess pressure was vented and the autoclave was opened. The reaction mixture was recovered and filtered to remove the catalyst from the reaction product. Analysis of the product by iodine value disclosed that there had been 14% double bond saturation, while quantitative gas chromatography showed a 24% conversion of oleic acid to esters and alcohols, the selectivity as measured by the percent of acid conversion divided by the percent of double bond saturation being 1.7.

In a like manner, when a catalyst comprising ruthenium composited on alumina was used in a reduction reaction involving oleic acid without a hydrogen bleed, analysis disclosed that there had been only a 23% conversion of the oleic acid to the esters and alcohols with a corresponding reduction of the double bond in the compound to greater than 90%.

It is therefore evident from a comparison of the results obtained in the above examples that, by utilizing a catalyst comprising cadmium, ruthenium and platinum in a low valence oxidation state composited on alumina while continuously bleeding hydrogen from the reactor with a concomitant removal of product water will produce results, especially in the area of selectivity, significantly greater than that which is obtained when utilizing other forms of reduction catalyst both with and without a continuous bleed of the hydrogen from the reaction vessel.

EXAMPLE V

In a manner similar to that hereinbefore set forth, other reduction catalysts such as cadmium, ruthenium and palladium in a low valence oxidation state composited on alumina may also be used in the treatment of other unsaturated acids such as crotonic acid, hypogeic acid, erucic acid, and hexenoic acid. Such a reductive reaction may include utilizing reaction conditions which include a temperature of 150° C. and a hydrogen pressure of 1000 psig for a period of 4 hours while continuously bleeding the hydrogen from the autoclave during this period in an amount sufficient to maintain the aforesaid pressure. The desired products from the reduction of these unsaturated acids such as crotonyl crotonate, crotonyl alcohol, hypogeyl hypogeate, hypogeyl alcohol, erucyl erucate, erucyl alcohol, hexenyl hexenate, hexenyl alcohol as well as geometric and positional isomers thereof may be recovered from the reaction mixture.

We claim as our invention:

1. A process for the reduction of an unsaturated carboxylic acid which comprises treating said acid in a reaction system in the presence of hydrogen and a reduction catalyst comprising cadmium and ruthenium-containing compounds, wherein said cadmium and ruthenium are present in a low valence oxidation state in an amount in the range of from about 1.0 to about 10.0 wt% cadmium and from about 0.1 to about 2.0 wt% ruthenium, composited on a solid support at a temperature in the range of from about 100° C. to about 500° C. and a pressure in the range of from about 100 to about 5000 lbs./sq. in., continuously bleeding said hydrogen from said system during the reaction period, and recovering the resultant unsaturated product.

2. The process as set forth in claim 1 in which said reduction catalyst also contains a platinum group metal of Group VIII of the Periodic Table in a low valence state in an amount in the range of from about 0.01 to about 2.5 wt%.

3. The process as set forth in claim 1 in which said solid support comprises a high surface area alumina.

4. The process as set forth in claim 3 in which said high surface area alumina is gamma-alumina.

5. The process as set forth in claim 2 in which said platinum group metal is platinum.

6. The process as set forth in claim 2 in which said platinum group metal is palladium.

7. The process as set forth in claim 1 in which said carboxylic acid is oleic acid and said unsaturated product is oleyl oleate, oleyl alcohol and geometric and positional isomers thereof.

8. The process as set forth in claim 1 in which said carboxylic acid is crotonic acid and said unsaturated product is crotonyl crotonate and crotonyl alcohol.

9. The process as set forth in claim 1 in which said carboxylic acid is hypogeic acid and said unsaturated product is hypogeyl hypogeate, hypogeyl alcohol and geometric and positional isomers thereof.

10. The process as set forth in claim 1 in which said carboxylic acid is erucic acid and said unsaturated product is erucyl erucate, erucyl alcohol and geometric and positional isomers thereof.

11. The process as set forth in claim 1 in which said carboxylic acid is hexenoic acid and said unsaturated product is hexenyl hexenate and hexenyl alcohol.

* * * * *